US006985689B2

(12) United States Patent
Nanataki et al.

(10) Patent No.: US 6,985,689 B2
(45) Date of Patent: Jan. 10, 2006

(54) IMAGE HEATING APPARATUS HAVING MULTIPLE ROTATABLE MEMBERS AND TEMPERATURE DETECTING ELEMENT

(75) Inventors: Hideo Nanataki, Kanagawa (JP); Taku Fukita, Shizuoka (JP); Yozo Hotta, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 83 days.

(21) Appl. No.: 10/717,478

(22) Filed: Nov. 21, 2003

(65) Prior Publication Data

US 2004/0136743 A1 Jul. 15, 2004

(30) Foreign Application Priority Data

Nov. 26, 2002 (JP) ..... 2002-341955

(51) Int. Cl.
*G03G 15/20* (2006.01)

(52) U.S. Cl. ..... 399/330; 399/328

(58) Field of Classification Search ..... 399/320, 399/328, 329, 330, 335, 338, 68, 69
See application file for complete search history.

(56) References Cited

U.S. PATENT DOCUMENTS

| | | | | |
|---|---|---|---|---|
| 4,920,250 A | * | 4/1990 | Urban | 399/328 X |
| 4,977,431 A | * | 12/1990 | Fuji | 399/69 |
| 5,331,385 A | | 7/1994 | Ohtsuka et al. | |
| 5,881,349 A | | 3/1999 | Nanataki et al. | 399/328 |
| 5,920,757 A | | 7/1999 | Izawa et al. | 399/329 |
| 5,970,299 A | | 10/1999 | Sano et al. | 399/330 |
| 6,005,594 A | | 12/1999 | Nanataki et al. | 347/156 |
| 6,031,215 A | | 2/2000 | Nanataki et al. | 219/619 |
| 6,049,691 A | | 4/2000 | Abe et al. | 399/330 |
| 6,072,964 A | | 6/2000 | Abe et al. | 399/69 |
| 6,075,228 A | | 6/2000 | Goto et al. | 219/216 |
| 6,088,549 A | | 7/2000 | Kagawa et al. | 399/67 |
| 6,131,010 A | | 10/2000 | Kume et al. | 399/333 |
| 6,246,843 B1 | | 6/2001 | Nanataki et al. | 399/45 |
| 6,289,185 B1 | * | 9/2001 | Cahill | 399/69 |
| 6,304,741 B1 | * | 10/2001 | Tange | 399/328 |
| 6,343,195 B1 | | 1/2002 | Abe et al. | 399/69 |
| 6,347,201 B1 | | 2/2002 | Sano et al. | 399/67 |
| 6,347,211 B2 | | 2/2002 | Nanataki et al. | 399/328 |
| 6,445,902 B1 | * | 9/2002 | Hirst et al. | 399/328 |
| 6,654,571 B2 | | 11/2003 | Nanataki et al. | 399/69 |
| 6,763,205 B2 | * | 7/2004 | Izawa et al. | 399/69 |
| 2003/0058320 A1 | | 3/2003 | Sano et al. | 347/103 |

FOREIGN PATENT DOCUMENTS

| | | |
|---|---|---|
| JP | 10-133505 | 5/1998 |
| JP | 11-52767 | 2/1999 |

(Continued)

*Primary Examiner*—Sandra L. Brase
(74) *Attorney, Agent, or Firm*—Fitzpatrick, Cella, Harper & Scinto

(57) ABSTRACT

An image heating apparatus has a first rotatable member contacting a second rotatable member, wherein the recording material bearing the image passes through a nip portion formed at a position between the first rotatable member and the second rotatable member; a heater for heating the first rotatable member, the heater having a third rotatable member that is flexible and a temperature detecting element, wherein the third rotatable member contacts an outer peripheral surface of the first rotatable member and the temperature detecting element is provided in an area of an inside surface said third rotatable member, wherein the first rotatable member and the third rotatable member contact; and a controller for controlling the heater based on detecting the temperature of said temperature detecting element.

8 Claims, 9 Drawing Sheets

FOREIGN PATENT DOCUMENTS

| | | |
|---|---|---|
| JP | 2000-19876 | 1/2000 |
| JP | 2002-123117 | 4/2002 |
| JP | 2002-221219 | 8/2002 |
| JP | 2002-236426 | 8/2002 |

* cited by examiner

IMAGE HEATING APPARATUS HAVING MULTIPLE ROTATABLE MEMBERS AND TEMPERATURE DETECTING ELEMENT

BACKGROUND OF THE INVENTION

1. Field of the Invention

The present invention relates to an image heating apparatus suitable for use as a heat-fixing apparatus mounted on an image forming apparatus, such as a copier or printer. In particular, it relates to an image heating apparatus having heating means which contacts an outer peripheral surface of a "roller contacting a toner image".

2. Related Background Art

Of image heat-fixing apparatus to be mounted on image forming apparatus, those of a heat roller type and a film heating type are in practical use.

Typically, the heat roller type involves pressing a fixing roller (heat roller) containing a heat source, such as a halogen lamp, against a pressure roller to form a nip portion that feeds a recording material. The heat source in the fixing roller is controlled based on the temperature detected by a temperature detecting element provided on an outer peripheral surface of the fixing roller. The heat-fixing apparatus of the film heating type comprise a film-like rotatable member (referred to as a film, hereinafter), a heater which contacts the inner surface of the film and comprises a heat-generating resistor on a substrate of ceramic or the like, and a pressure roller pressed against the heater with the film interposed therebetween, in which a recording material is fed between the film and the pressure roller to heat the toner image thereon. Such fixing apparatus have a temperature detecting element for detecting the temperature of the heater, and the heat generation by the heater is controlled based on the temperature detected by the temperature detecting element.

As described above, typically, in such apparatus, the turn-on of the heater is controlled to apply an adequate quantity of heat to the recording material.

In the case of the heat roller type, the temperature of the surface of the heat roller is typically controlled by measuring the temperature of the surface with temperature measuring means, such as a thermistor, which is brought into contact with the surface.

In the case of the film heating type, the temperature of the heater is controlled by detecting the temperature with a thermistor abutting against the heater.

However, the fixing apparatus of the heat roller type have a problem that the thermistor abutting against the fixing roller causes a scratch on the surface of the roller or a soil or the like on the thermistor impairs the image. To avoid the problem, the thermistor may be disposed out of the sheet-feeding area of the fixing roller. However, the temperature of the sheet-feeding area of the fixing roller is difficult to control because it cannot be directly detected. A temperature detecting element which does not contact the fixing roller may be used. However, the tradeoff is a higher cost. Besides, the fixing apparatus of the heat roller type have a basic problem that they have a high thermal capacity and require a long time to be activated to an operable state. On the other hand, in the fixing apparatus of the film heating type, since the thermistor is disposed in contact with the heater, it does not cause a scratch on the film surface. In addition, the fixing apparatus of the film heating type have a low thermal capacity, and, thus, require a shorter time to be activated to an operable state. However, if the film has no resilient layer, it is difficult to ensure a sufficient nip width and to heat the toner in a wrap-around manner. Therefore, they are not suitable for fixing a full-color toner image, although they are suitable for fixing a monochrome toner image. Besides, if the film has a resilient layer, there arises a problem that, because of the heat insulation by the resilient layer, the heater reaches its target temperature and stops generating heat before a sufficient quantity of heat is transferred to the film surface, so that the nip portion is not heated to a temperature suitable for fixing.

Thus, there has been devised a method of heating the fixing roller from the outside thereof (externally heating type) (eg. Japanese Patent Application Laid-Open No. H10-133505). According to this method, since heat can be supplied to the roller from the outside thereof, the temperature of the roller is highly responsive to the turn-on of the heater, and, thus, the activation time can be shortened.

However, if the temperature detecting means abuts against the roller surface, this method also has a problem of a scratch, soil or the like as in the heat roller type. In addition, the temperature of the fixing apparatus is difficult to control, and a disadvantage, such as hot offset of a toner image or fixability reduction, may occur.

Thus, there is a need for an image heating apparatus that has a short activation time and an adequate fixability for a full-color toner image and is insusceptible to scratch on the surface of a rotatable member contacting a toner image.

SUMMARY OF THE INVENTION

The present invention has been made in view of the problems described above, and an object thereof is to provide an image heating apparatus that is insusceptible to scratch on the surface of a rotatable member contacting a toner image and has a short activation time.

Another object of the present invention is to provide that is insusceptible to scratch on the surface of a rotatable member contacting a toner image and ensures an adequate fixability for a full-color toner image.

Another object of the present invention is to provide that has a short activation time and an adequate fixability for a full-color toner image and is insusceptible to scratch on the surface of a rotatable member contacting a toner image.

Another object of the present invention is to provide an image heating apparatus that is insusceptible to hot offset and fixability reduction.

Another object of the present invention is to provide an image heating apparatus for heating an image formed on a recording material, comprising:

first rotatable member;

said first rotatable member contacting second rotatable member, wherein the recording material bearing the image passes through a nip portion formed at a position between said first rotatable member and said second rotatable member;

heating means for heating said first rotatable member, said heating means including a third rotatable member that is flexible and a temperature detecting element, wherein the third rotatable member contacts an outer peripheral surface of said first rotatable member with the third member, wherein the temperature detecting elements is provided in an area of an inside surface said third rotatable member, wherein said first rotatable member and said third rotatable member contacts in the area; and control means for controlling said heating means based on detecting the temperature of said temperature detecting elements.

Other objects of the present invention will be apparent by reading the following detailed description with reference to the appended drawings.

DESCRIPTION OF THE PREFERRED EMBODIMENTS

<Embodiment 1> (See FIGS. 1 to 6, 7A and 7B)

(1) Example of Image Forming Apparatus

Figure 2:
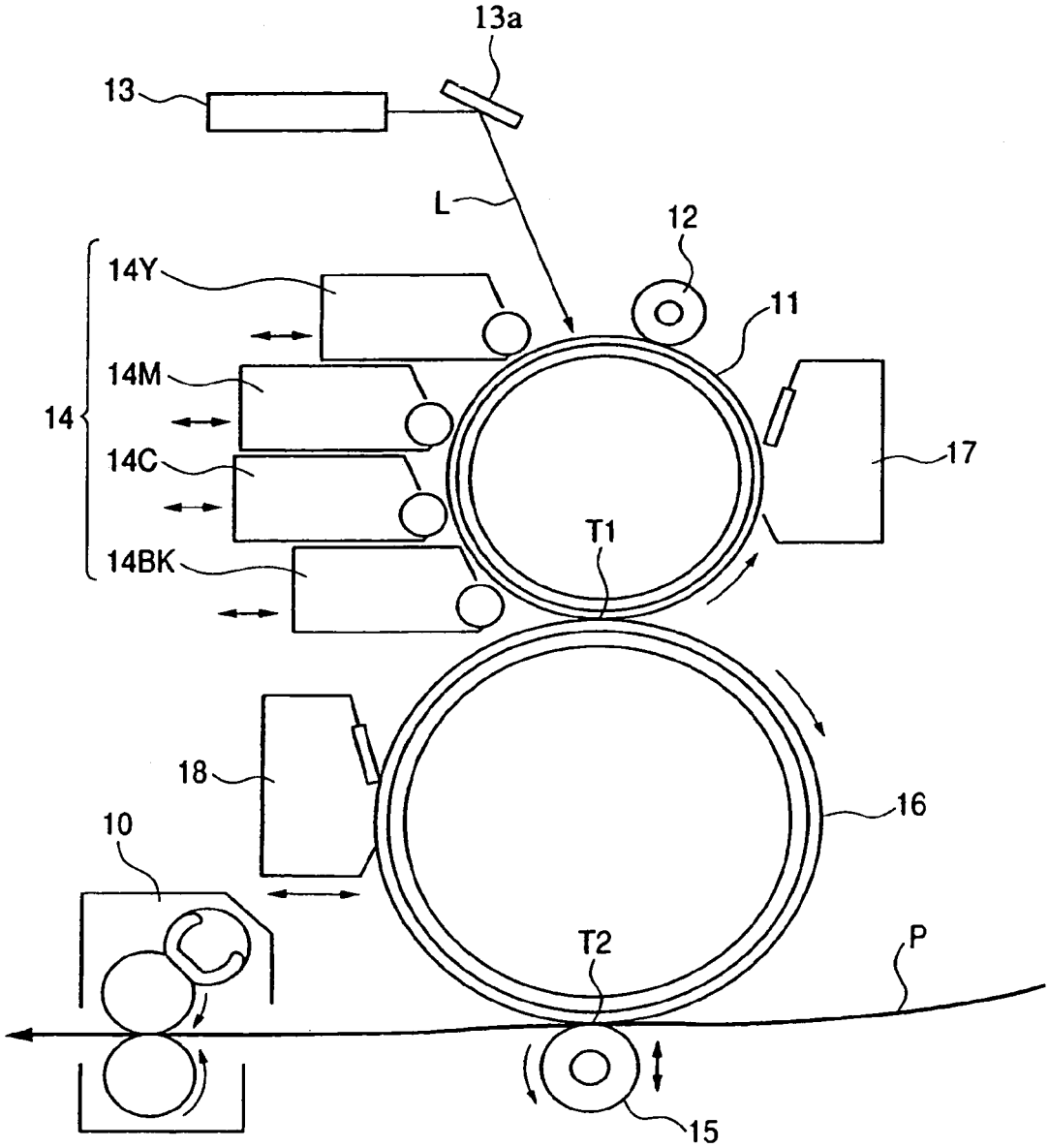
FIG. 2 is a schematic diagram showing an image forming apparatus on which an image heating apparatus according to the invention is mounted.

FIG. 2 is a schematic diagram showing an example of an image forming apparatus. The image forming apparatus according to this example is an electrophotographic full-color printer, and is a center-reference device in which the feeding reference for a recording material is the middle along the width of the recording material.

Reference numeral 11 denotes an electrophotographic photosensitive drum (image carrier) made of an organic photoconductor, which is rotated at a predetermined process speed (peripheral speed) of 120 mm/s in a direction as indicated by an arrow.

During rotation, the photosensitive drum 11 is uniformly electrified with predetermined polarity and potential by an electrifier 12, such as an electrification roller.

The electrified photosensitive surface is scanned with a laser beam L emitted from a laser optical unit (laser scanner) 13. This causes an electrostatic latent image associated with image information to be formed on the photosensitive drum. The laser optical unit 13 is to emit a laser beam L modulated (turned on/off) based on the image information from a computer or the like (not shown), thereby achieving scan-exposure of the photosensitive drum surface to the laser beam L. By the scan-exposure, there is formed an electrostatic latent image corresponding to the target image information on the scan-exposed surface of the photosensitive drum 11. Reference numeral 13*a* denotes a mirror that reflects the laser beam emitted from the laser optical unit 13 toward an exposure-target area of the photosensitive drum 11.

In the case of forming a full-color image, scan-exposure and latent image formation are first performed on a first color component image of a target full-color image, for example, an yellow component image, and an yellow developer 14Y of a four-color image forming apparatus 14 develops the resulting latent image to form an yellow toner image. The yellow toner image is transferred to a surface of an intermediate transfer drum 16 at a primary transfer portion T1, which is a portion where the photosensitive drum 11 and the intermediate transfer drum 16 are in contact with each other (or close to each other). Once the toner image is transferred to the intermediate transfer drum 16, a cleaner 17 cleans residues, such as remaining toner, off the surface of the photosensitive drum 11.

The process cycle including the electrification, scan-exposure, development, primary transfer and cleaning described above is sequentially performed on the remaining color component images of the target full-color image, that is, a second color component image (for example, a magenta component image, which is developed by a magenta developer 14M), a third color component image (for example, a cyan component image, which is developed by a cyan developer 14C), and a fourth color component image (for example, a black component image, which is developed by a black developer 14BK). Thus, the yellow toner image, the magenta toner image, the cyan toner image and the black toner image are transferred onto the surface of the intermediate transfer drum 16 in a superimposition manner, thereby forming a composite color image corresponding to the target full-color image.

The intermediate transfer drum 16 comprises a metallic drum, a resilient layer of a moderate resistance and an outer layer of a high resistance. It is rotated in a direction indicated by an arrow at substantially the same speed as the photosensitive drum 11 in a state where it is in contact with or close to the photosensitive drum 11. A bias potential is applied to the metallic drum to provide a potential difference between the photosensitive drum 11 and the intermediate transfer drum 16, which causes the toner image on the photosensitive drum 11 to be transferred to the intermediate transfer drum 16.

At a secondary transfer portion T2, which is constituted by a contact nip portion between the intermediate transfer drum 16 and a transfer roller 15, the composite color toner image formed on the intermediate transfer drum 16 is transferred to the surface of a recording material P fed, at a predetermined timing, from a sheet feeder unit (not shown) to the secondary transfer portion T2. The transfer roller 15 supplies charge of the polarity opposite to that of toner to the recording material P form the back thereof, thereby causing the composite color toner image on the intermediate transfer drum 16 to be sequentially transferred to the recording material P.

The recording material P having passed through the secondary transfer portion T2 is separated from the surface of the intermediate transfer drum 16 and introduced into a fixing apparatus 10, where the unfixed toner image is subject to a heat fixing process. Then, the recording material P with the color image is ejected onto an output tray (not shown).

The fixing apparatus 10 is an image heating apparatus according to the present invention and will be described in detail later in the section (2).

Once the color toner image is transferred to the recording material P, a cleaner 18 cleans residues, such as remaining toner and paper dust, off the intermediate transfer drum 16. The cleaner 18 is spaced apart from the intermediate transfer drum 16 in a normal state, and is in contact with the intermediate transfer drum 16 during the secondary transfer of the color toner image from the intermediate transfer drum 16 to the recording material P.

Besides, the transfer roller 15 is also spaced apart from the intermediate transfer drum 16 until the fourth color (BK) image is formed, and is in contact with the intermediate transfer drum 16 during the secondary transfer of the color toner image from the intermediate transfer drum 16 to the recording material P.

In the monochrome image formation, in contrast to the full-color-image formation, only the black developer 14BK is activated, and switching among the developers does not occur. An image for the following page can be successively formed on the intermediate transfer drum 16, and a series of image forming operations is conducted with the transfer roller 15 and the cleaner 18 kept abutting against the intermediate transfer drum 16. Therefore, a monochrome image can be formed at a speed about four times higher than that for a full-color image. In this example, the recording speed is 4 pages per minute for full-color image (A4 size) and is 16 pages per minute for monochrome image.

Figure 10:
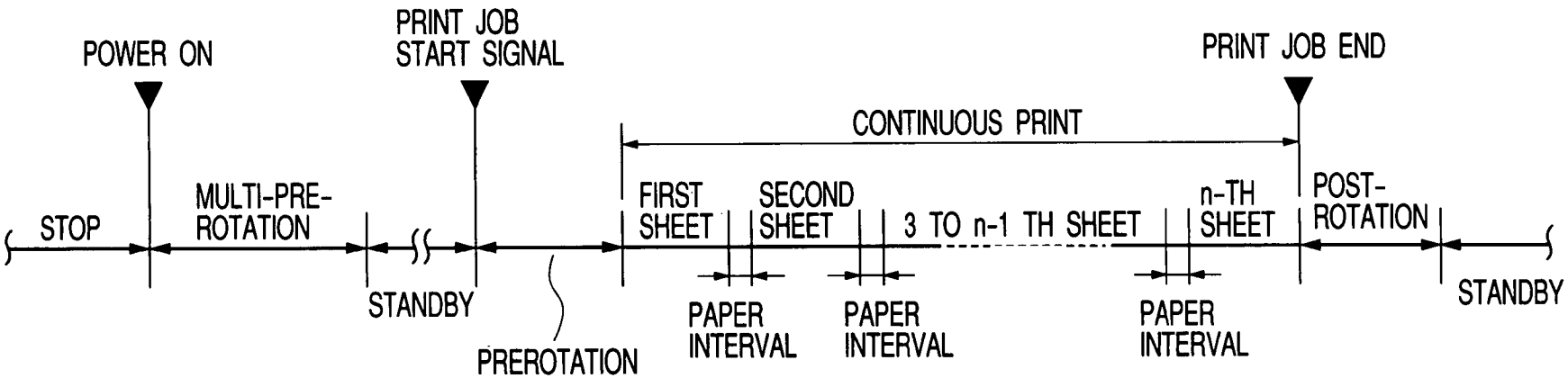
FIG. 10 shows a process of an operation of the image forming apparatus.

Image formation can be successively conducted by repeating the operation described above. FIG. 10 shows a process of the operation of the image forming apparatus.

1) Multi-Pre-Rotation Step

This is a period for stating (activating) the image forming apparatus (warm-up period). The main power switch of the image forming apparatus is turned on to activate a main motor thereof, thereby preparing a desired processing unit.

2) Stand-By Step

After the predetermined starting period, the main motor is stopped, and the image forming apparatus is kept in a stand-by (waiting) state until a print job starting signal is input.

3) Prerotation Step

This is a period in which the main motor is restarted in response to input of the print job starting signal, and a pre-print-job operation of a desired processing unit is performed.

In a more practical order, the image forming apparatus receives the print job starting signal, develops an image using a formatter (the development time varies depending on the amount of image data and the processing speed of the formatter), and then, the multi-pre-rotation step is started.

Here, if the print job starting signal is input during the multi-pre-rotation step, the stand-by step is omitted, and the prerotation step is entered directly after the multi-pre-rotation step is completed.

4) Print Job Execution Step

Once the predetermined prerotation step is completed, the image forming process described above is performed, and the recording material with the image formed thereon is output.

In the case of successive print jobs, the image forming process described above is repeated, and a predetermined number of recording materials with the respective images formed thereon are output.

5) Paper Interval Step

This is a step for providing an interval between the trailing edge of a recording material P and the leading edge of the following recording material P in the case of successive print jobs. This step corresponds to a period in which no sheet is fed in the transfer portion and the fixing apparatus.

6) Post-Rotation Step

This is a period in which the main motor is continuously kept moving to perform a post-print-job operation of a desired processing unit after the recording material with the image formed thereon is output (after the print job is finished) in the case of a one-sheet print job, or after the last recording material with the image formed thereon is output (after the print jobs are finished) in the case of successive print jobs.

7) Stand-By Step

After the predetermined post-rotation step is completed, the main motor is stopped, and the image forming apparatus is kept in a stand-by state until the next print job starting signal is input.

(2) Fixing Apparatus 10

Figure 1:
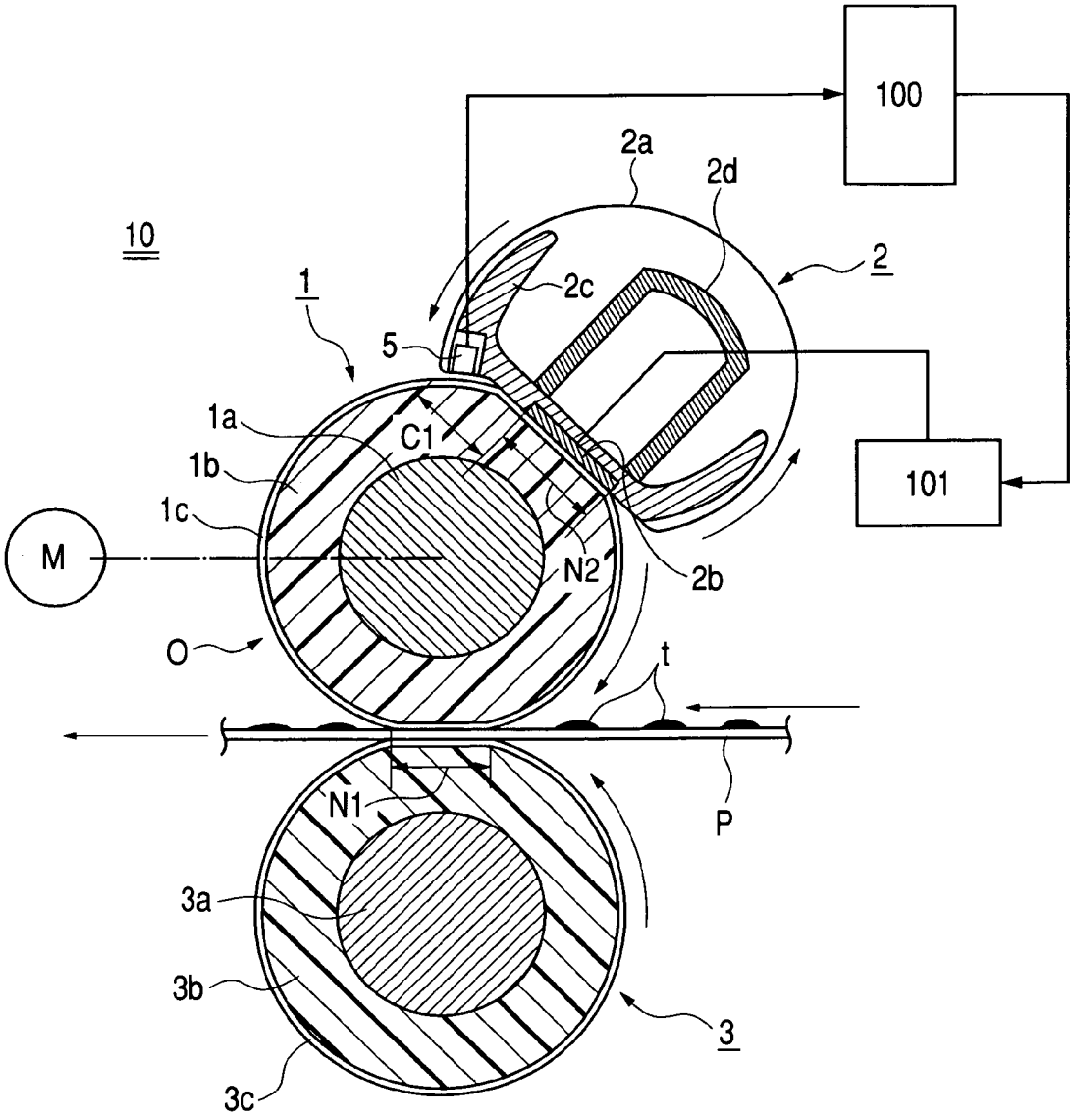
FIG. 1 is a cross sectional view of a fixing apparatus according to an embodiment 1 of the invention.

FIG. 1 is a partially cut away schematic view of the fixing apparatus 10. The fixing apparatus 10 mainly comprises a fixing roller (first rotatable member) 1 and a pressure roller (second rotatable member) 3, which constitute a rotatable member pair, and a surface heating unit (heating means) 2 for the fixing roller 1.

The fixing roller 1 is a resilient roller having an outer diameter of 20 mm which comprises a cored bar 1*a*, a silicone rubber layer 1*b* having a thickness of 3 mm coating the outer peripheral surface of the cored bar and a PFA resin layer 1*c* having a thickness of 50 $\mu$m coating the outer peripheral surface of the silicone rubber layer.

Similarly, the pressure roller 3 is a resilient roller having an outer diameter of 20 mm which comprises a cored bar 3*a*, a silicone rubber layer 3*b* having a thickness of 3 mm coating the outer peripheral surface of the cored bar and a PFA resin layer 3*c* having a thickness of 50 $\mu$m coating the outer peripheral surface of the silicone rubber layer. The pressure roller 3 is pressed against the fixing roller 1 under a predetermined pressure (100N) to form a fixing nip N1.

The surface heating unit 2 comprises a ceramic heater 2*b* as heating means, a heater holder 2*c* supporting the ceramic heater 2*b*, and an endless-belt (cylindrical) heating film (third rotatable member) 2*a* rotatably fitted on the outer peripheral surface of the heater holder 2*c*. A pressure stay 2*d* presses the heater holder 2*c* onto the fixing roller 1 against the resilience of the resilient layer 3*b* of the fixing roller 1 to press the heater 2*b* against the fixing roller 1 with the heating film 2*a* interposed therebetween, thereby forming a heating nip N2.

The heater holder 2*c* has a film guiding surface shaped so as to provide an extended film contact portion C1 for the heating film 2*a* to contact the fixing roller surface in an area upstream of the heater 2*b* (heating nip N2) in the direction of the rotation of the fixing roller.

That is, the heating film 2*a* is guided by the heater holder 2*c* so as to contact the fixing roller 1 at the heating nip N2 and the contact portion C1 upstream of the heating nip.

According to this embodiment, in the extended film contact portion C1 of the surface heating unit 2, a thermistor 5 as temperature detecting means is provided in such a manner that it is constantly pressed by a spring or the like against the surface of the heating film 2*a* opposite to that in contact with the fixing roller 1, that is, the inner surface (back surface) of the film.

The heating film 2*a* comprises a polyimide (PI) resin layer having a thickness of 40 $\mu$m coated with a PFA resin layer having a thickness of 10 $\mu$m and has a perimeter of 56.5 mm. The ceramic heater 2*b* comprises an alumina substrate having a width of 8 mm and a thickness of 1 mm, a resistor printed thereon and a protective glass layer formed thereon and has an output power of 700 W.

The fixing roller 1 is rotated by driver means M in a clockwise direction as indicated by the arrow in FIG. 1. As the fixing roller 1 rotates, the pressure roller 3, which follows the fixing roller 1, rotates in a direction indicated by the arrow by friction arising in the fixing nip N1. In addition, the heating film 2*a* of the surface heating unit 2, which follows the fixing roller 1, slides along the outer peripheral surface of the heater holder 2*c* in a counterclockwise direction indicated by the arrow by friction arising in the heating nip N2 and the extended film contact portion C1 with the inner surface thereof kept in contact with the surface of the heater 2*b* and the thermistor 5.

In addition, when a power supply circuit 101 energizes the heat-generating resistor layer, the temperature of the ceramic heater 2*b* of the surface heating unit 2 rises rapidly. The heat generation by the heater 2*b* causes the surface of the rotating fixing roller 1 to be heated via the heating film 2*a* in the heating nip portion N2.

The thermistor 5 detects the surface temperature of the fixing roller 1 via the heating film 2*a*. Based on the temperature detected by the thermistor 5, a control circuit 100 adjust the power supplied from the power supply circuit 101 to the ceramic heater 2*b*, thereby controlling the surface temperature of the fixing roller 1 to be kept at a predetermined fixing temperature.

Following the fixing roller 1 rotated, the pressure roller 3 and the heating film 2*a* of the surface heating unit 2 rotate. In addition, the ceramic heater 2*b* of the surface heating unit 2 is energized to heat the surface of the fixing roller 1, and the surface temperature of the fixing roller 1 is controlled at a predetermined fixing temperature. In this state, a recording material P carrying an unfixed toner image t, which is to be heated, is introduced into the fixing nip portion N1 between the fixing roller 1 and the pressure roller 3. The recording material P is brought into intimate contact with the outer peripheral surface of the fixing roller 1 and passes through the fixing nip portion N1 as the fixing roller 1 rotates. During the process of passing through the fixing nip portion, the toner image t is heated via heat conduction from the fixing roller 1 and fixed. The recording material P having passed through the fixing nip portion N1 is separated from the outer peripheral surface of the fixing roller 1 at the recording material outlet of the fixing nip portion N1 and ejected.

(3) Temperature Control

In this embodiment, the surface heating unit 2 supplies heat to the fixing roller 1 from the outer surface (outer peripheral surface) thereof, and the heat supplied to the fixing roller 1 is used to heat the recording material P. To follow the change of the temperature of the fixing roller surface, the power supply condition of the ceramic heater 2 is controlled by PID (PID is to determine the next condition by a proportional, integral or derivative processing based on the temporal change of the past temperature). Thus, the heater according to this embodiment can change the amount of generated heat in a stepwise manner.

Figure 3:
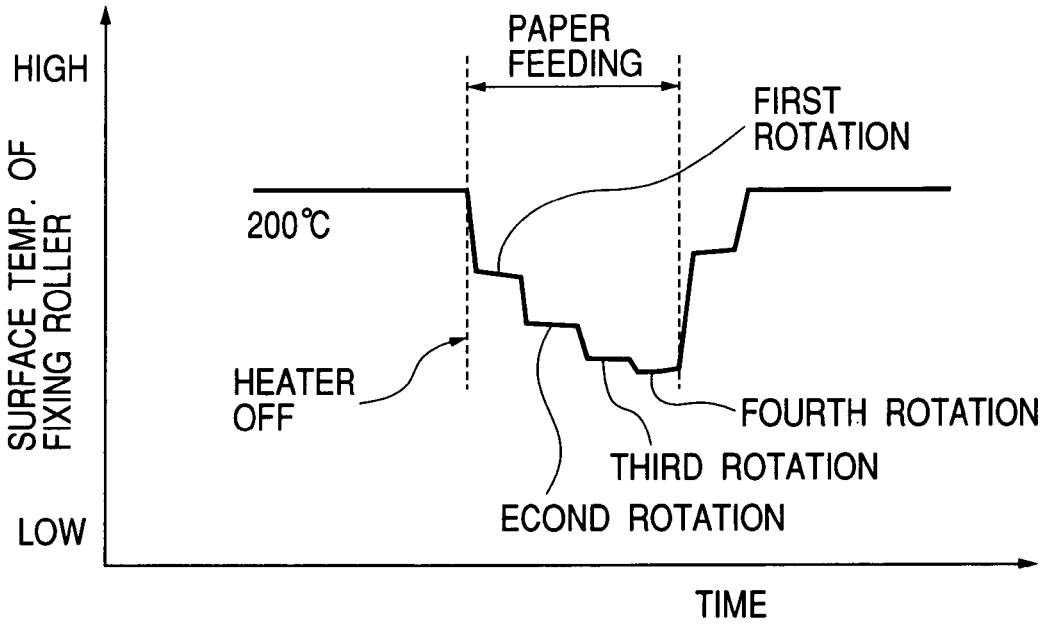
FIG. 3 shows a change of the temperature of a surface of a fixing roller measured at a point O in FIG. 1 in the case where a sheet of paper is fed after the fixing apparatus is warmed up and then energization to a heater is stopped.

Now, a change of the surface temperature of the fixing roller 1 due to paper feeding is examined. Experimentally, after the surface temperature of the fixing roller 1 is kept at a certain temperature (200° C.), power supply to the ceramic heater 2*b* is stopped, and one recording material P is inserted into the fixing nip N1. Then, the surface temperature of the fixing roller 1 measured at a point O at the recording material outlet side (ejection side) of the fixing nip N1 varies as shown in FIG. 3. In the case of this fixing apparatus, the fixing roller rotates about four times while one recording material passes through the fixing nip. As shown in FIG. 3, the temperature detected at the point O decreases stepwise when the recording material passes through the fixing nip. This is because the recording material deprives the surface of the fixing roller 1 of heat as the rotation continues. In addition, the temperature detected at the point O returns to its original level after the trailing edge of the recording material have passed through the fixing nip. This is cause by heat accumulated in the fixing roller or pressure roller before feeding of the recording material. In this way, if energization of the heater is stopped before paper feeding, the surface temperature of the fixing roller at the point O, that is, immediately after the fixing roller has passed through the fixing nip decreases stepwise and then rises as shown in FIG. 3. Therefore, to achieve uniform fixing from the leading edge to the trailing edge of the recording material, an amount of heat equal to the amount of heat of which the recording material has deprived the fixing roller has to be supplied from the ceramic heater 2*b* to the fixing roller 1 to maintain a uniform heat supply capability to the recording material.

During the first rotation of the fixing roller 1 after the recording material is fed, heat accumulated during heating before feeding of the recording material (in the paper interval step and the prerotation step) builds up not only in the surface but also in the depth of the roller and vicinity of the surface thereof, and thus, the heat supply capability is high. During the second rotation, the heat supply capability decreases. This is probably because heat supply from the vicinity of the surface of the roller is insufficient. Then, as the rotation continues, heat is further supplied from the depth of the roller to the vicinity of the surface thereof, and thus, the heat supply capability tends to get better.

Thus, first, an arrangement is considered in which the thermistor is disposed close to the point O, and energization of the heater is controlled so as to keep the temperature detected by the thermistor at a preset value.

As described above, if the recording material is fed after energization to the heater is stopped, the temperature of the fixing roller in the vicinity of the point O decreases stepwise. Even if the heater is energized also during paper feeding to compensate for the temperature reduction, the surface temperature of the fixing roller changes as is shown in FIG. 3 (although it is slightly higher than that in FIG. 3), because the point O is located next to the fixing nip, and the fixing roller surface has just been deprived of heat by the recording material when it reaches the point O. Therefore, even if the thermistor is disposed in the vicinity of the point O, and the heater is controlled to generate heat during paper feeding, the temperature detected by the thermistor decreases gradually. Besides, the heater generates more heat when the thermistor detects a lower temperature. As a result, an excessive amount of heat is supplied to the recording material. In addition, while heat supplied by the heater is accumulated not only in the surface of the fixing roller but also inside of the fixing roller, heat accumulation building inside of the fixing roller cannot be measured in the vicinity of the point O. As a result, an excessive amount of heat is supplied to the recording material, and a hot offset of toner occurs.

On the other hand, according to this embodiment, the thermistor is disposed inside the heating film (third rotatable member) of the surface heating unit and in an area where the fixing roller (first rotatable member) and the heating film are in contact with each other. That is, the thermistor 5 detects the surface temperature of the fixing roller 1 via the heating film 2*a*, so that there is a temperature gradient between them due to a thermal resistance. Thus, the excessive heat generation by the heater can be avoided, and the hot offset can be prevented. In addition, since the thermistor is not direct contact with the fixing roller, the fixing roller surface can be prevented from suffering a scratch. Furthermore, in this embodiment, a higher target temperature is set for the paper feeding period to address the problems described above. Specifically, the target temperature is 180° C. for the period in which no sheet of paper is fed (paper interval period) and 200° C. for the paper feeding period.

Figure 4:
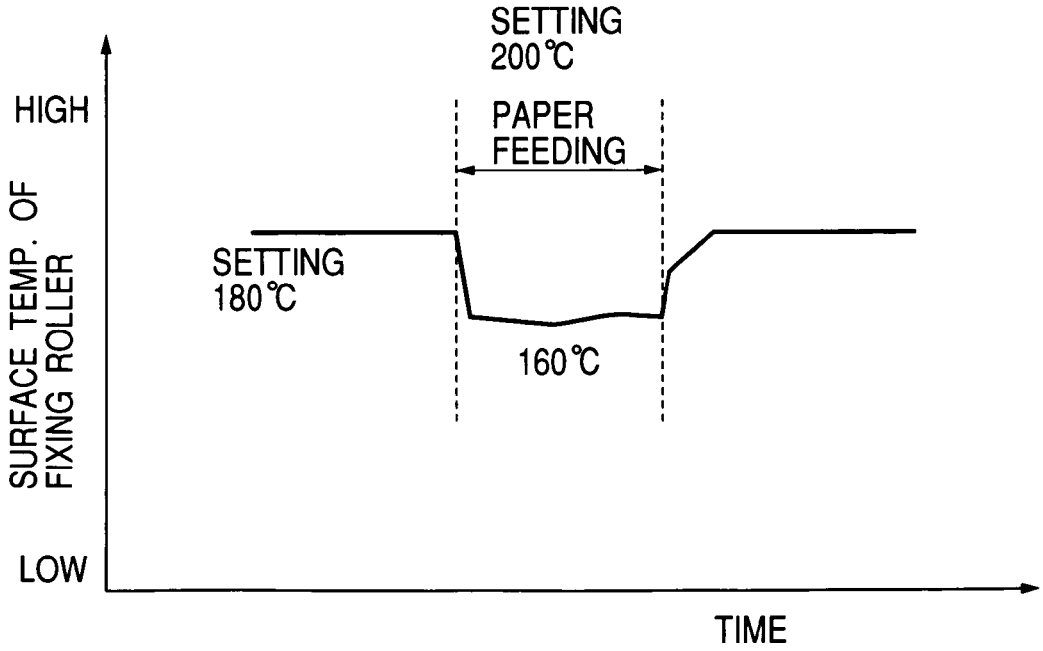
FIG. 4 shows a change of the temperature of a surface of a fixing roller measured at the point O in FIG. 1 in the embodiment 1.

Thus, the ceramic heater 2*b* is energized and controlled so as to keep the surface temperature of the fixing roller at the ejection side substantially uniform (160° C.) as shown in FIG. 4.

In this embodiment, in the case of full-color image formation, which involves more toner and accordingly requires more heat for fixing, the paper interval (distance between the trailing edge of a recording material and the leading edge of the following recording material) can be about five times longer than the length of the recording material. Thus, the heat supply capability can be advantageously increased by maintaining the rotation and heating of the fixing roller in the fixing apparatus 10 to ensure a sufficient heat accumulation in the fixing roller 1.

(4) Comparative Examples

Figure 5:
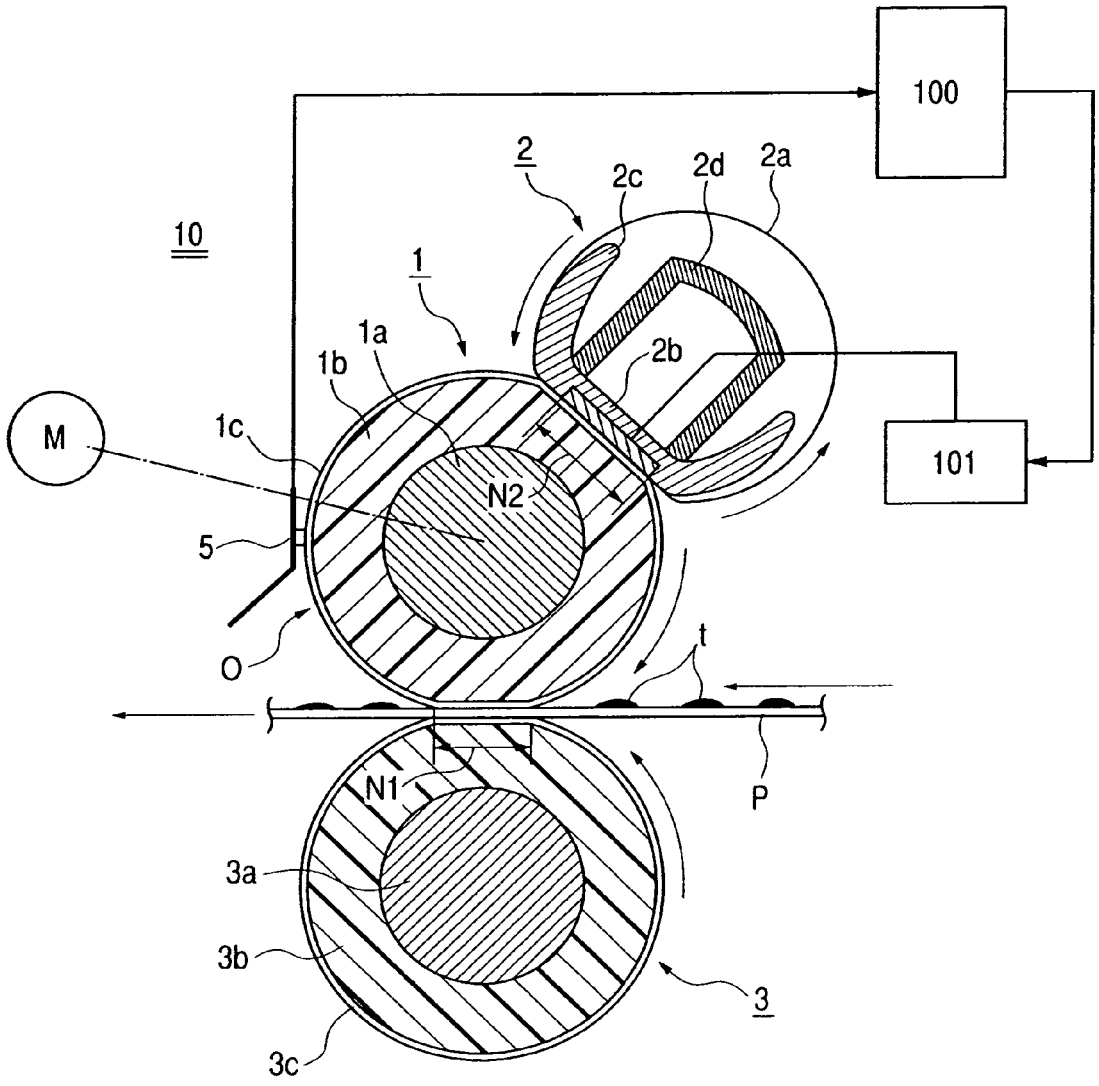
FIG. 5 PRIOR ART
FIG. 5 is a cross sectional view of a fixing apparatus according to a Comparative Example 1.
Figure 6:
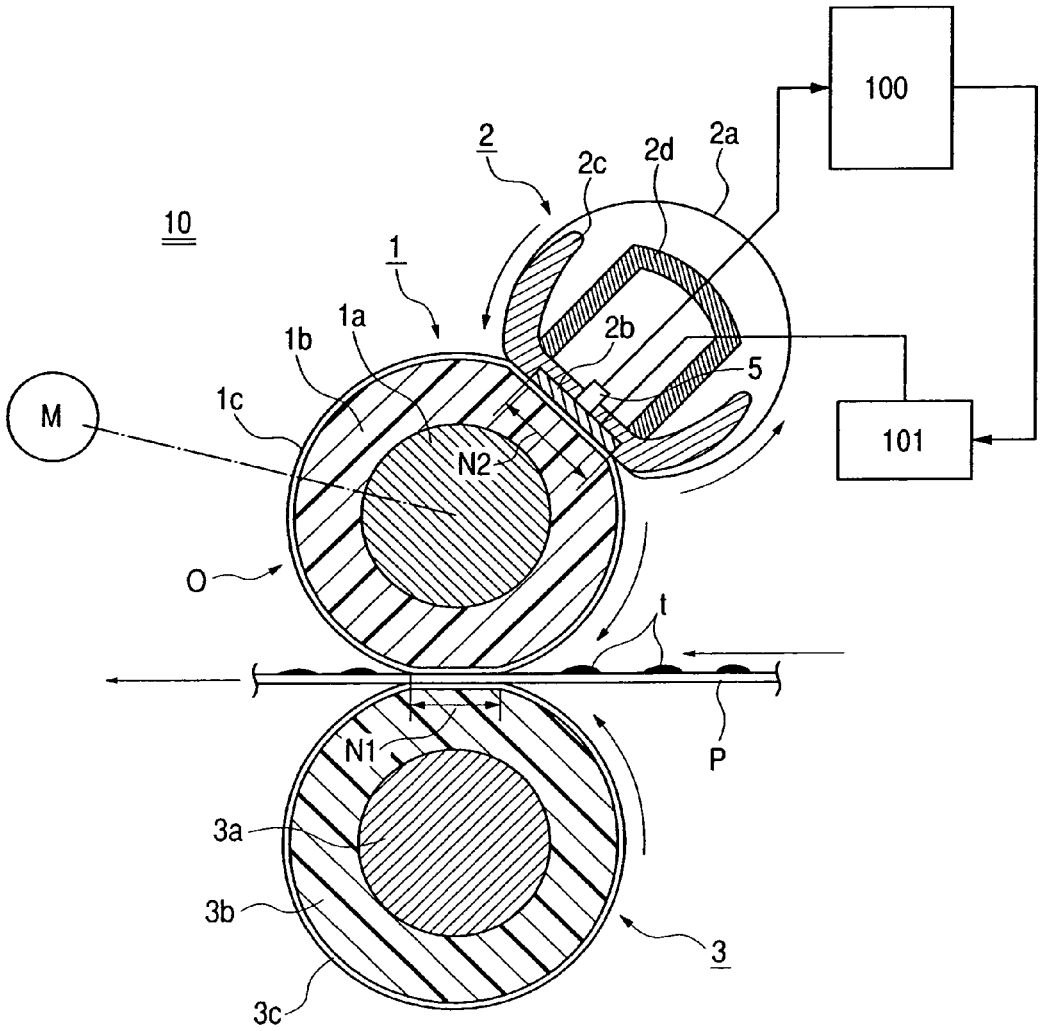
FIG. 6 PRIOR ART
FIG. 6 is a cross sectional view of a fixing apparatus according to a Comparative Example 2.

FIGS. 5 and 6 are partially cut away side views showing examples of arrangement of the temperature detecting means according to Comparative Examples. FIG. 5 shows an arrangement in which the thermistor 5 is disposed immediately following the fixing nip and at the middle along the axis of the fixing roller (Comparative Example 1). FIG. 6 shows an arrangement in which the thermistor 5 abuts against the ceramic heater 2*b* (Comparative Example 2).

Figure 7A:
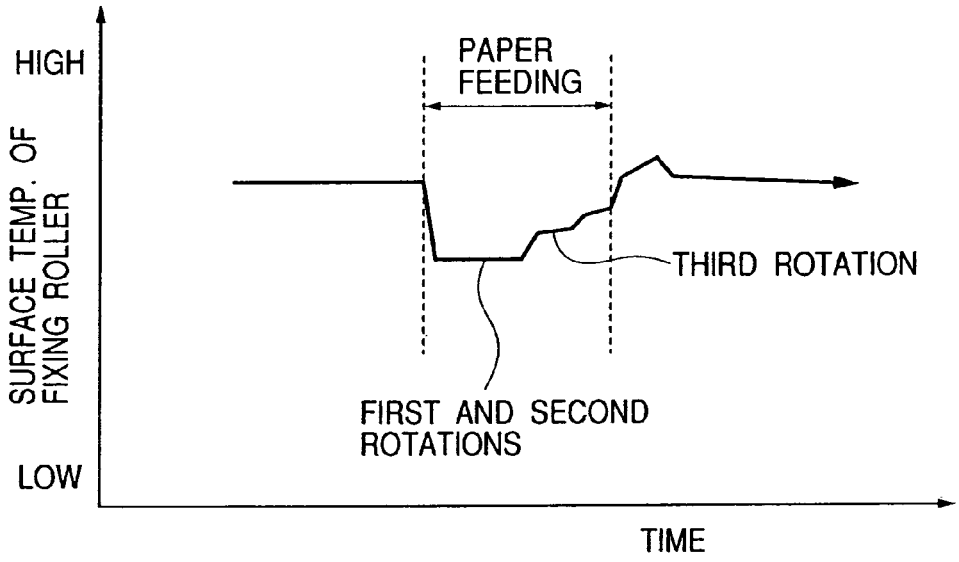
FIG. 7A PRIOR ART
FIGS. 7A and 7B show changes of the surface temperature of the fixing roller measured at the point O in the Comparative Examples 1 and 2.
Figure 7B:
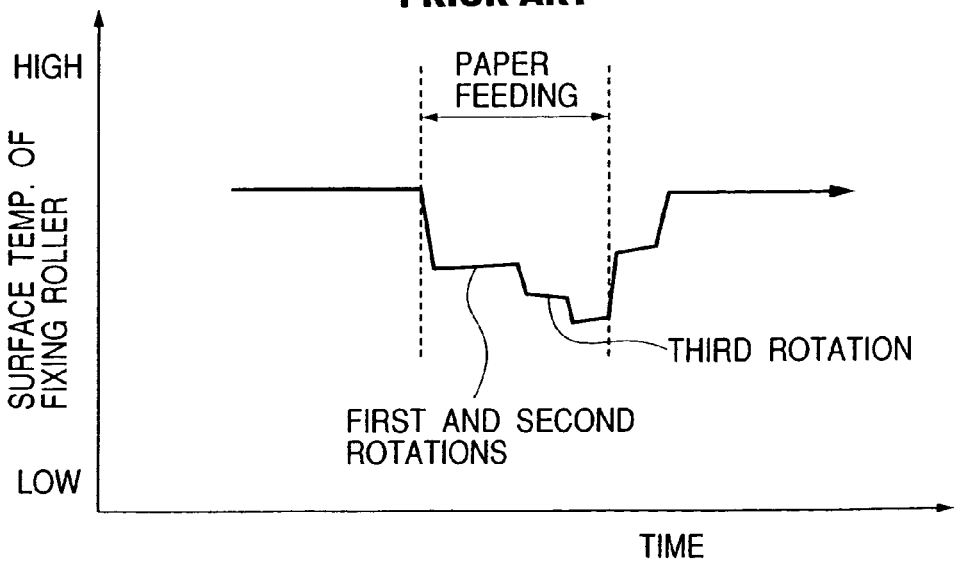
FIG. 7B PRIOR ART

Changes of the temperature of the fixing roller measured at the point O in the Comparative Examples 1 and 2 are shown in FIGS. 7A and 7B, respectively.

In the Comparative Example 1, while the temperature during the second rotation is controlled to be equal to that during the first rotation, the temperature rises during the third and later rotations, and a hot offset occurs in the latter half of the recording material. This is because the thermistor disposed as shown in FIG. 5 detects the temperature of only the surface of the fixing roller having just been deprived of heat by the recording material, and thus, the heat accumulation in the depth of the fixing roller 1 is not reflected to the temperature control, as described above. In addition, since the thermistor is in direct contact with the fixing roller, a scratch is made on the surface of the fixing roller.

On the other hand, in the Comparative Example 2, while the temperature during the second rotation is controlled to be equal to that during the first rotation, the temperature decreases during the third and later rotations, and a poor fixing occurs in the later half of the recording material. This is probably because, since the thermistor 5 detects the temperature increase in the ceramic heater 2, it is insensitive to the temperature reduction in the surface of the fixing roller 1 and fails to raise the power.

In contrast to these Comparative Examples, according to this embodiment, the thermistor 5 detects the surface temperature of the fixing roller 1, and the heat generation condition of the ceramic heater 2 is fed back via the film. Thus, the recovery of the heat supply capability for the second and later rotations can be compensated for, and thus, an excessive rise or reduction of the temperature of the fixing roller 1 does not occur.

In addition, in the Comparative Example 1, there arise problems that the thermistor 5 makes a scratch on the surface of the fixing roller 1, and soil, such as toner residues or paper dust, is accumulated at the area where the thermistor 5 and the fixing roller 1 are in contact with each other, resulting in a poor quality or impairment of the image on the recording material. To the contrary, in this embodiment, since the thermistor 5 abuts against the inner surface of the heating film 2*a*, such problems don't occur.

In short, according to the present invention, since the surface heating method is adopted, there can be provided a fixing apparatus and an image forming apparatus which have an advantageously shortened activation time (about 15 seconds), avoids a hot offset and poor fixing unlike the Comparative Examples as shown in Table 1, and does not suffer an image impairment.

TABLE 1

| | Soil | Hot offset | Fixability |
|---|---|---|---|
| Comparative Example 1 | x | x | o |
| Comparative Example 2 | o | o | x |
| This embodiment | o | o | o |

x = unaccettable
o = acceptable.

Figure 8:
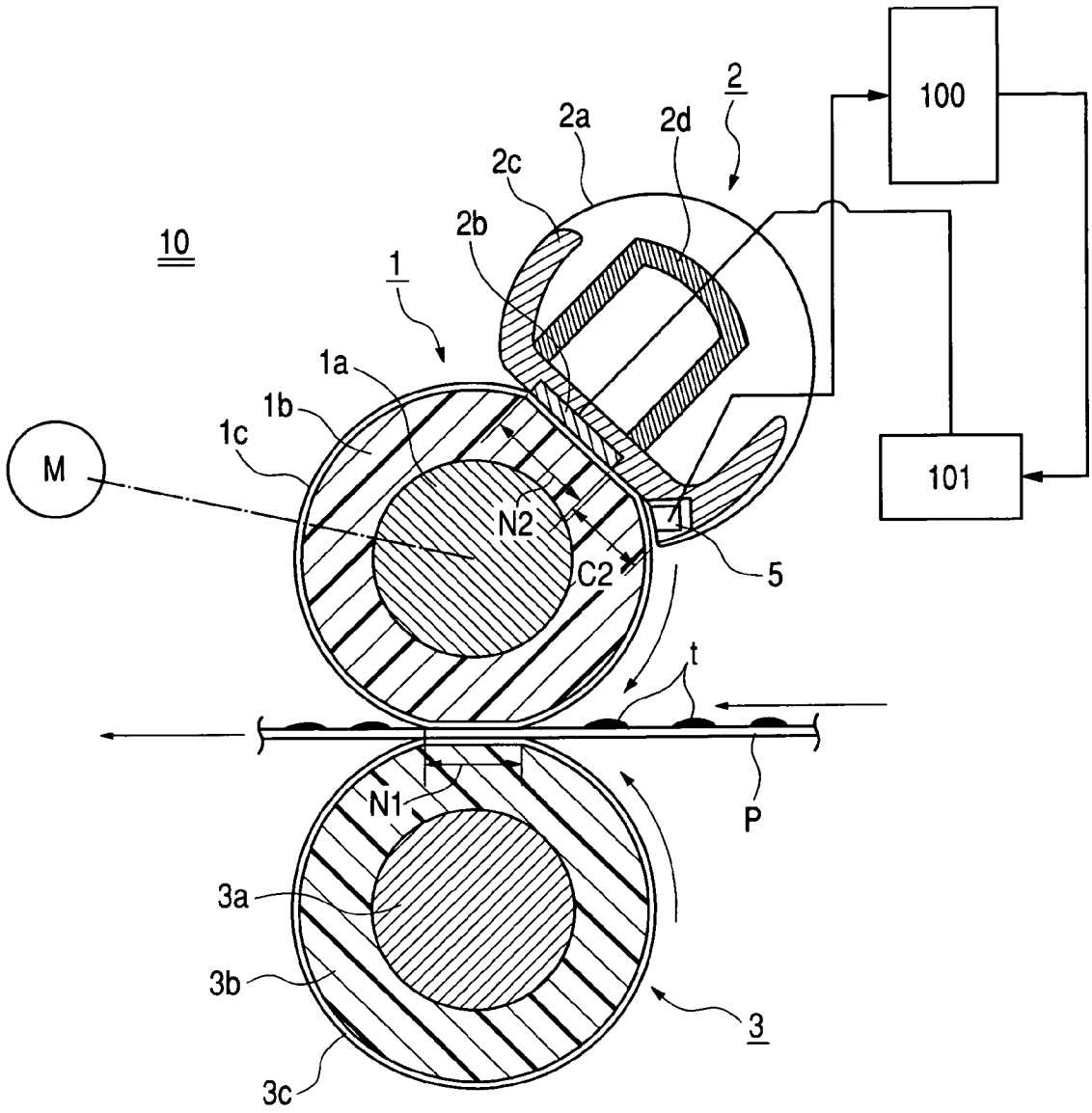
FIG. 8 is a cross sectional view of a fixing apparatus according to an embodiment 2.

<Embodiment 2> (See FIG. 8)

FIG. 8 is a partially cut away schematic diagram showing the fixing apparatus 10 according to an embodiment 2.

The apparatus according to this embodiment is the same as the apparatus shown in FIGS. 1 to 6, 7A and 7B except for the position of the thermistor 5 as shown in FIG. 1.

That is, in the apparatus according to this embodiment, the heater holder 2*c* has a film guiding surface shaped so as to provide an extended film contact portion C2 for the heating film 2*a* to contact the fixing roller surface in an area downstream of the heater 2*b* (heating nip N2) in the direction of the rotation of the fixing roller. The heating film 2*a* is guided by the heater holder 2*c* so as to contact the fixing roller 1 at the heating nip N2 and the contact portion C2 downstream of the heating nip. And, in the extended film contact portion C2 of the surface heating unit 2, the thermistor 5 as temperature detecting means is provided in such a manner that it is constantly pressed by a spring or the like against the surface of the heating film 2*a* opposite to that in contact with the fixing roller 1, that is, the inner surface (back surface) of the film.

Since the thermistor 5 detects, via the heating film 2*a*, the temperature of the fixing roller having passed through the heating nip N2, the result of heating is reflected to the control of the apparatus, and thus, stable control can be achieved.

In addition, advantageously, the surface temperature of the fixing roller 1 is monitored and controlled at the point upstream of the fixing nip N1 in the direction of the rotation of the fixing roller, and thus, the temperature of the fixing roller can be controlled by compensating for the variation of the heat supply condition in the heating nip N2 resulting form variations of the ceramic heater 2*b* or power supply voltage.

In this embodiment, if a metallic film, such as stainless, nickel or copper film, is used as the heating film 2*a* instead of the polyimide (PI) resin film, a negative-feedback control with a higher responsibility can be achieved, and a more uniform fixability can be attained.

Figure 9:
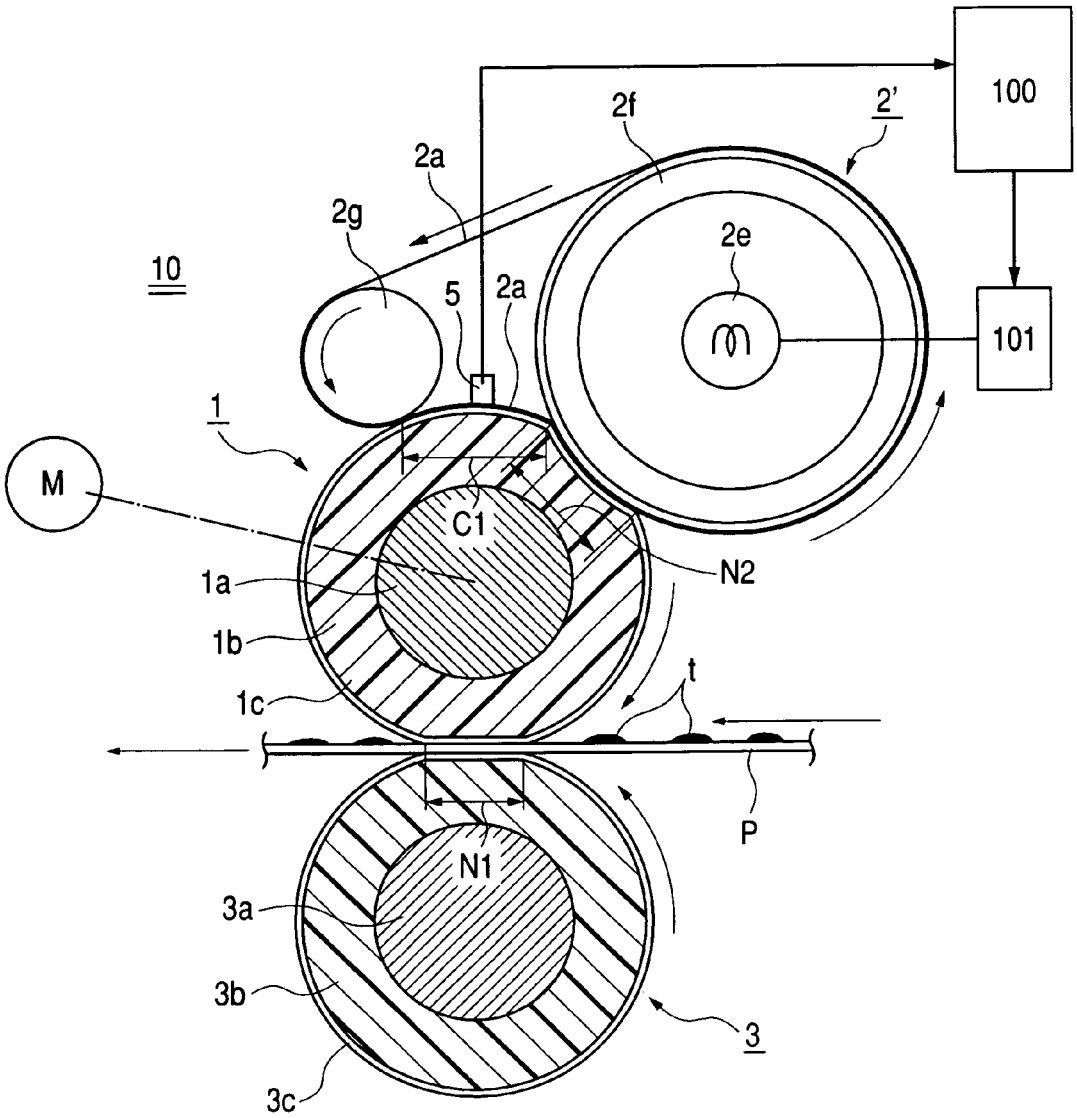
FIG. 9 is a cross sectional view of a fixing apparatus according to an embodiment 3.

<Embodiment 3> (See FIG. 9)

FIG. 9 is a partially cut away schematic diagram showing the fixing apparatus 10 according to an embodiment 3.

The apparatus according to this embodiment is the same as the apparatus shown in FIGS. 1 to 6, 7A and 7B, except for the configuration of the surface heating unit 2' as shown in FIG. 9.

The surface heating unit 2' comprises a heating roller 2*f*, a halogen heater 2*e* contained in the heating roller 2*f*, a heating film 2*a* rotatably fitted onto the outer peripheral surface of the heating roller 2*f*, and a tension roller 2*g* for exerting a tension to the heating film 2*a*.

The heating roller 2*f* is a hollow cylinder made of aluminum having a thickness of 1 mm and a diameter of 30 mm. The halogen heater 2*e* has an output power of 700 W. The heating roller 2*f* abuts against the fixing roller 1 with the heating film 2*a* interposed therebetween to form the heating nip N2. The heating film 2*a*, the heating roller 2*f* and the tension roller 2*g* rotate by following the fixing roller 1.

The heating film 2*a* comprises a PI resin layer having a thickness of 50 $\mu$m coated with a fluororesin layer having a thickness of 10 $\mu$m and has a perimeter of 120 mm.

The tension roller 2*g* is a roller made of stainless having a thickness of 1 mm and a diameter of 15 mm. It exerts a tension of 20 N to the heating film 2*a* and makes the heating film 2*a* move along the surface of the fixing roller 1 to form an extended film contact portion C1 where the heating film 2*a* contact the fixing roller surface upstream of the heating roller 2*f* (heating nip N2) in the direction of the rotation of the fixing roller. The thermistor 5 is in contact with the inner surface of the film at the extended film contact portion C1.

This embodiment has an advantage that, since the heating roller 2*f* having a relatively high thermal capacity is used as the heat source, the temperature is less likely to vary due to turn-on/off of the halogen heater 2*e* and a uniform fixability can be achieved, although the activation time is slightly longer (about 30 seconds).

In addition, since the heating roller 2*f* is a rotatable member, and the film can rotate at a low torque by following the heating roller, there is an advantage that the film can run stably.

<Others> a) As for the rotatable pressure member 3 in the embodiments 1 to 3, instead of the pressure roller, a pressure film unit consisting of an endless belt and a pressure member disclosed in Japanese Patent Application Laid-Open No. 2001-228731 may be used for reducing the thermal capacity.

b) The fixing roller 1 serving as the heating rotatable member may be hollow, and a halogen heater or the like may be contained in the hollow as auxiliary heating means.

c) The heating rotatable member 1 is not limited to the roller configuration and may be a rotatable belt member.

d) The heating apparatus according to the present invention is not used exclusively as the image heat-fixing apparatus of the embodiments. It may be widely used as means or apparatus for heating a material, such as an image heating apparatus that heats a recording material carrying an image to reform the surface characteristics, such as luster, image heating apparatus for temporary fixing, an heating and drying apparatus for a material to be heated, and a heating lamination apparatus.

While various embodiments and examples of the present invention have been described above, it will be understood by one skilled in the art that the spirit and scope of the present invention is not limited to the specific description herein and the appended drawings, and the present invention includes various modifications and alterations as set forth in the claims.

What is claimed is:

1. An image heating apparatus for heating an image formed on a recording material, comprising:

first rotatable member, said first rotatable member contacting second rotatable member, wherein the recording material bearing the image passes through a nip portion formed at a position between said first rotatable member and said second rotatable member;

heating means for heating said first rotatable member, said heating means including a third rotatable member that is flexible and a temperature detecting element, wherein the third rotatable member contacts an outer peripheral surface of said first rotatable member, wherein the temperature detecting elements is provided in an area of an inside surface said third rotatable member, wherein said first rotatable member and said third rotatable member contacts in the area; and control means for controlling said heating means based on detecting the temperature of said temperature detecting elements, wherein said heating means has a heater provided inside of said third rotatable member and in an area where said first rotatable member and said third rotatable member are in contact with each other, and wherein the temperature detecting element is provided upstream of said heater in the direction of the rotation of said third rotatable member.

2. An image heating apparatus according to claim 1, wherein said third rotatable member is a resin film.

3. An image heating apparatus according to claim 1, wherein said third rotatable member is a metallic film.

4. An image heating apparatus according to claim 1, wherein said control means controls energization to said heating means so as to keep the temperature detected element at a set temperature, and the set temperature is higher when the recording material passes through the nip portion than before it passes through the nip portion.

5. An image heating apparatus for heating an image formed on a recording material, comprising:

a first rotatable member, said first rotatable member contacting a second rotatable member, wherein the recording material bearing the image passes through a nip portion formed at a position between said first rotatable member and said second rotatable member;

heating means for heating said first rotatable member, said heating means including a third rotatable member that is flexible and a temperature detecting element, wherein the third rotatable member contacts an outer peripheral surface of said first rotatable member, wherein the temperature detecting element is provided in an area of an inside surface of said third rotatable member, and wherein said first rotatable member and said third rotatable member contact in the area; and control means for controlling said heating means based on detecting the temperature of said temperature detecting elements, wherein said heating means has a heater provided inside of said third rotatable member and in an area where said first rotatable member and said third rotatable member are in contact with each other, and wherein said temperature detecting element is provided downstream of said heater in the direction of the rotation of said third rotatable member.

6. An image heating apparatus according to claim 5, wherein said third rotatable member is a resin film.

7. An image heating apparatus according to claim 5, wherein said third rotatable member is a metallic film.

8. An image heating apparatus according to claim 5, wherein said control means controls energization to said heating means so as to keep the temperature detecting element at a set temperature, and the set temperature is higher when the recording material passes through the nip portion than before it passes through the nip portion.

* * * * *

UNITED STATES PATENT AND TRADEMARK OFFICE

CERTIFICATE OF CORRECTION

PATENT NO. : 6,985,689 B2
APPLICATION NO. : 10/717478
DATED : January 10, 2006
INVENTOR(S) : Hideo Nanataki et al.

It is certified that error appears in the above-identified patent and that said Letters Patent is hereby corrected as shown below:

SHEET NO. 3 of 9:
Figure 3, “ECOND” should read --SECOND--.

COLUMN 4:
Line 4, “an” (both occurrences) should read --a--.
Line 6, “an” should read --a--.

COLUMN 7:
Line 18, “adjust” should read --adjusts--.

COLUMN 8:
Line 2, “have” should read --has--.
Line 7, “avoids” should read --avoid--.
Line 64, “direct” should read --in direct--.

COLUMN 10:
Line 57, “form” should read --from--.

COLUMN 12:
Line 15, "elements" should read --element--.
Line 18, "contacts" should read --contact--.

Signed and Sealed this

Twenty-fifth Day of July, 2006

JON W. DUDAS
*Director of the United States Patent and Trademark Office*